US006145202A

United States Patent [19]

Onion

[11] Patent Number: 6,145,202

[45] **Date of Patent: *Nov. 14, 2000**

[54] OPENING AND CLOSING ASSISTING MECHANSIM FOR FOLDING KNIFE

[75] Inventor: Kenneth J. Onion, Kapolei, Hi.

[73] Assignee: Kai U.S.A. Ltd., Wilsonville, Oreg.

[ * ] Notice: This patent is subject to a terminal disclaimer.

[21] Appl. No.: 09/096,870

[22] Filed: Jun. 11, 1998

Related U.S. Application Data

[60] Provisional application No. 60/077,390, Mar. 10, 1998.

[51] Int. Cl.[7] ..... B26B 1/04

[52] U.S. Cl. ..... 30/160; 30/161

[58] Field of Search ..... 30/155, 158, 159, 30/160, 161

[56] References Cited

U.S. PATENT DOCUMENTS

| | | | |
|---|---|---|---|
| 226,910 | 4/1880 | Friebertshauser . | |
| D. 365,266 | 12/1995 | Hasegawa . | |
| 551,052 | 12/1895 | Shonnard | 30/159 |
| 749,230 | 1/1904 | Severance . | |
| 1,743,022 | 1/1930 | Carman . | |
| 4,347,665 | 9/1982 | Glesser | 30/161 |
| 4,404,748 | 9/1983 | Wiethoff et al. | 30/161 |
| 4,451,982 | 6/1984 | Collins | 30/161 |
| 4,719,700 | 1/1988 | Taylor . | |
| 4,811,486 | 3/1989 | Cunningham | 30/161 |
| 4,837,932 | 6/1989 | Elsener . | |
| 4,896,424 | 1/1990 | Walker . | |
| 4,974,323 | 12/1990 | Cassady | 30/155 |
| 5,060,379 | 10/1991 | Neely | 30/161 |
| 5,095,624 | 3/1992 | Ennis | 30/161 |
| 5,111,581 | 5/1992 | Collins | 30/161 |
| 5,293,690 | 3/1994 | Cassady | 30/161 |
| 5,331,741 | 7/1994 | Taylor, Jr. | 30/158 |
| 5,400,509 | 3/1995 | Collins | 30/161 |
| 5,437,101 | 8/1995 | Collins . | |
| 5,502,895 | 4/1996 | Lamaier . | |
| 5,537,750 | 7/1996 | Seber . | |
| 5,692,304 | 12/1997 | Campbell | 30/161 |
| 5,737,841 | 4/1998 | McHenry et al. | 30/161 |
| 5,802,722 | 9/1998 | Maxey et al. | 30/161 |
| 5,815,927 | 10/1998 | Collins | 30/161 |
| 5,964,036 | 10/1999 | Centofante . | |

FOREIGN PATENT DOCUMENTS

| | | | |
|---|---|---|---|
| 1069862 | 7/1954 | France | 30/159 |
| 1248117 | 10/1960 | France . | |
| 1104386 | 4/1961 | Germany | 30/158 |

*Primary Examiner*—Hwei-Siu Payer
*Attorney, Agent, or Firm*—Kolisch Hartwell Dickinson McCormack & Heuser

[57] ABSTRACT

This invention relates to a mechanism in a folding knife that urges the blade to move to an open and alternatively to a closed position. The knife generally cnsists of a blade member having a tang extending outwardly from the blade; a handle having at least one recessed portion; a bar pivotally connecting the tang and the handle; and a bias element engaging the blade wherein the bias element is housed within the recessed portion of the handle. Generally, in the present invention, the blade must be moved manually a certain distance whereupon the mechanism serves to complete the movement of the blade without the application of further outside force by the user.

34 Claims, 2 Drawing Sheets

FIG. 6
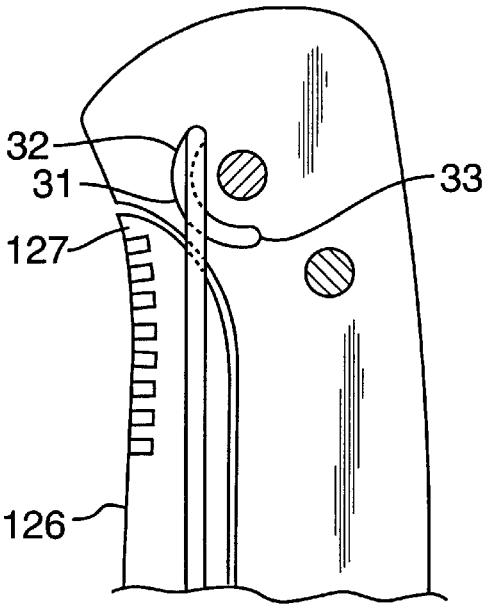
FIG. 7
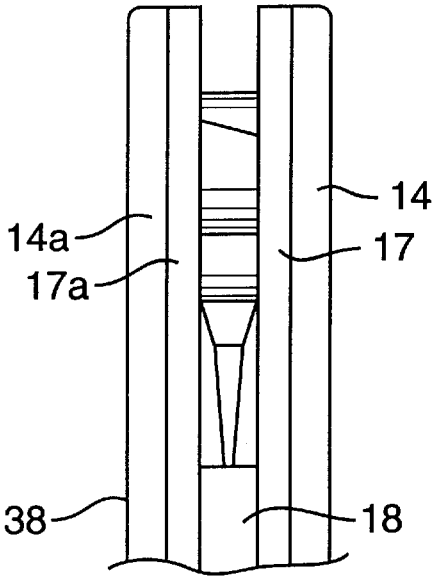
FIG. 8
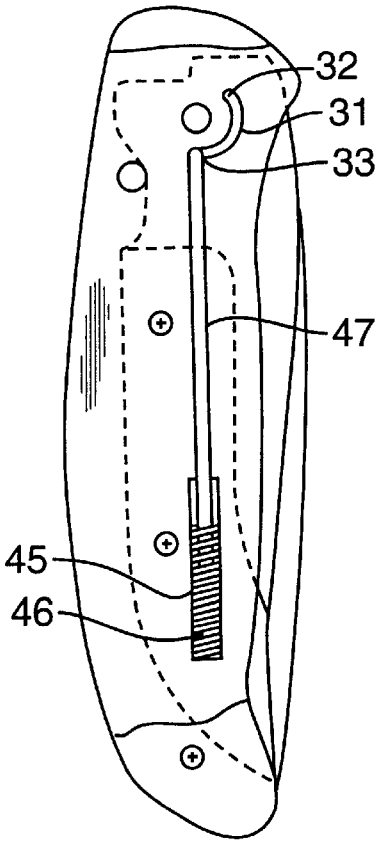
FIG. 9
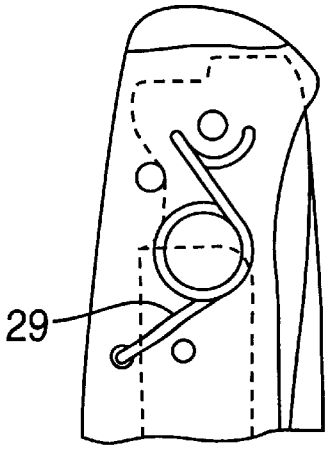
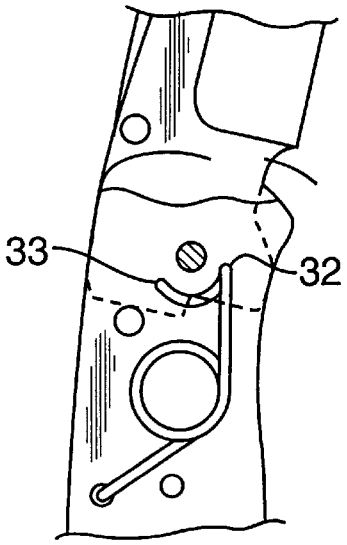
FIG. 10

OPENING AND CLOSING ASSISTING MECHANSIM FOR FOLDING KNIFE

This appln. claims benefit of Ser. No. 60/077,390 Mar. 10, 1998.

BACKGROUND OF THE INVENTION

This invention relates to a mechanism in a folding knife that urges the blade to move to an open and alternatively to a closed position. Generally, in the present invention, the blade must be moved manually a certain distance whereupon the mechanism serves to complete the movement of the blade without the application of further outside force by the user.

In the folding knife and cutlery industry, there typically is provided a folding knife having a housing or handle for supporting the blade in the open position and for receiving the blade in the closed position. It is also generally known to cause the blade of the knife to be locked when in the open position. An example of such locking mechanism is found in Neely U.S. Pat. No. 5,060,379 and Wiethoff U.S. Pat. No. 4,404,748. The mechanism of the present invention overcomes the various deficiencies of the folding knives and opening and closing mechanisms presently in the knife and cutlery industry by providing positive opening and closing assistance while enabling such opening and closing to be performed or carried out with only a single hand of the user, to the advantage of the general public but especially to persons who experience difficulty in using two hands to open a knife, whether such difficulty is caused by physical, mental or safety reasons.

SUMMARY OF THE INVENTION

The present invention generally provides for a folding knife generally comprising of a blade, a handle for receiving and supporting the blade and a mechanism located within the handle that communicates with the blade and provides positive assistance for opening and closing of the blade. The mechanism generally includes a bias element in communication with an arcuate slot in the tang of the blade. A thumb bob or stud may be attached to the blade for ease of opening and a locking means, such as a liner lock, may be provided within the handle of said knife for locking the blade in the open position.

DESCRIPTION OF THE DRAWINGS

FIG. 6 is an enlarged sectional view of an alternative embodiment of the knife, taken along line 6,6 of FIG. 5;

FIG. 7 is an enlarged sectional view of the knife, taken along lines 7,7 of FIG. 3;

FIG. 8 is a modified side view of the knife in the closed position of an alternate embodiment of the present invention;

FIG. 9 is a fragmentary side view of the knife in a closed position of a second alternate embodiment;

FIG. 10 is a fragmentary side view of the second alternate embodiment in the open position.

DESCRIPTION OF THE PREFERRED EMBODIMENT

Figure 1:
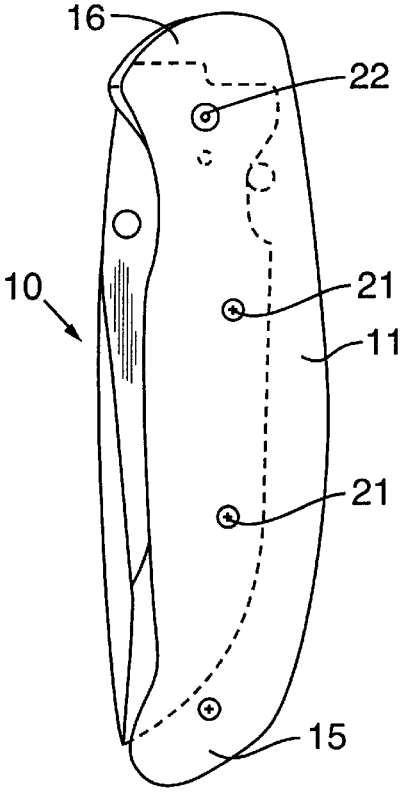
FIG. 1 of the drawings is a side view of a folding knife embodying the present invention.
Figure 2:
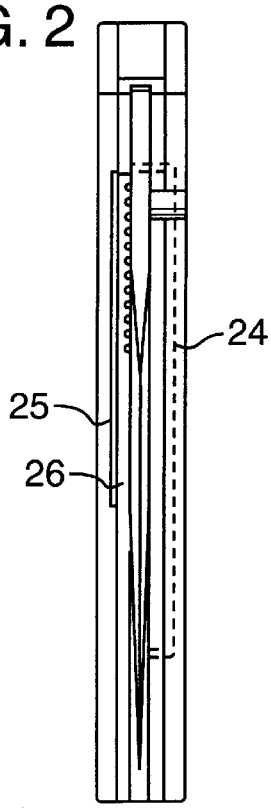
FIG. 2 is a top view of the knife in the closed position.

Referring to FIGS. 1 through 7, the knife 10 is generally composed of a handle or casing 11, a mechanism 12 held within the handle or casing and a blade 13.

The handle has side parts 14, 14*a*, each with a tapered rear end 15 and a rounded front end 16. Each side has an interior lining 17, 17*a* which communicates with the outer edge of the interior side of parts 14, 14*a*. The interior linings are connected to a central casing member 18 which communicates with the interior linings bottom and rear edges to form a central cavity 19. The interior of the central casing 18 is curved according to the shape of the blade 13 and forms a stop for the blade when the blade is placed in the closed position. Each side part 14/14*a* and lining 17/17*a* has a plurality of threaded holes 21 that receive screws which secure the sides together and an opening for a pivot bar 22. The interior linings 17/17*a* are joined near the front end 16 of the handle by a stop bar 23.

Figure 5:
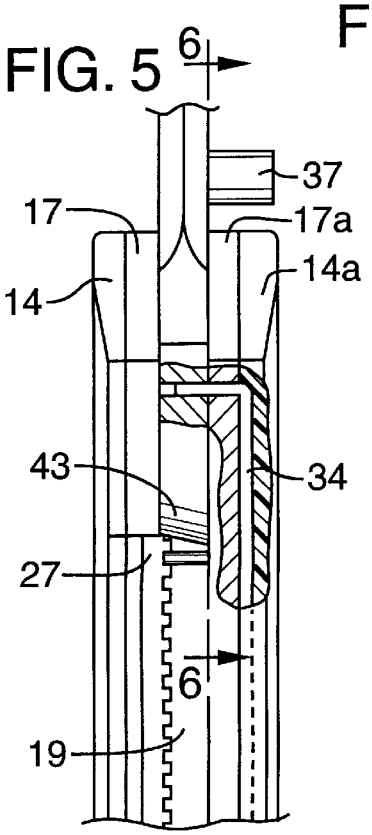
FIG. 5 is an enlarged partial top view of the knife in the open position, taken along the lines 5,5 of FIG. 4.

Side part 14*a* has a recessed portion 24 that does not communicate with the interior lining, and side part 14 has a recess 25 communicate with the interior lining. A portion of interior lining 17, indicated in FIG. 2 as lining portion 26 is separate from the lining 17 at the front end of the handle and is displaceable. Portion 26 is biased like a leaf spring so that the lining portion 26 extend into the central cavity 19 of the handle when the blade is placed in the open position, as shown in FIG. 5. The forward end 27 of the displaceable lining portion 26 communicates with the tang 28 of the blade when the blade is in the open position so as to prevent folding of the blade into the central cavity 19 because free end 27 is in the path of travel of tang 28, preventing pivoting of blade 13.

A side view of a lining portion 126 is shown in FIG. 6, as part of an alternative embodiment of the present knife, in which the moveable lining portion 126 is formed in interior lining 17*a*, on the same side of the handle as recessed portion 24. For both embodiments, the recess adjacent the moveable lining portion 26 or 126 allows free end 27 and 127 to be pressed manually so that free end 27 or 127 is completely out of the path of travel of tang 28, allowing folding of the blade back into the central cavity 19.

Figure 4:
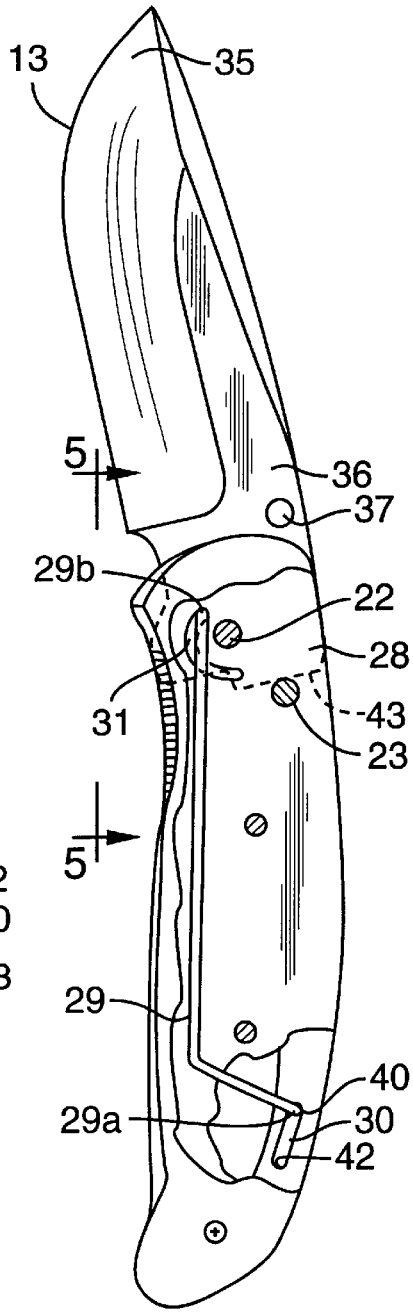
FIG. 4 is a side view of the knife in the open position displaying the preferred assisting mechanism within the handle, with portions broken away to better illustrate the contruction of the knife.

The recessed portion 24 houses a mechanism 12 generally composed of a bias element 29 formed in interior lining 17*a*, as shown in FIG. 4, and that isoperatively connected to blade 13 through a second groove 31 a first groove 30. The bias element 29 is generally the length of the handle 11 and has a first bend end 29*a* and a second bent end 29*b*. The first and second ends are turned at approximately 90° from the body 34 of the bias element. The first end 29*a* is received within the first groove 30. The second end 29*b* is located near the front 16 of the handle and is received within an arcuate second groove 31 in the interior lining 17*a* and a corresponding hole in the tang 28 of the blade 13.

Stop bar 23 extends across the front end of the central cavity 19. The stop bar 23 fits within a recess 20 in the tang of the blade when the blade is in the closed position and communicates with the front edge 43 of the tang when the blade is in the open position.

The blade 13 has a distal end 35 and a proximal end 36, with tang 28 adjacent to the proximal end of the blade.

Thumb bob 37 is mounted on a side of the blade near the proximal end and outside the tang area. The tang 28 has an arcuate slot corresponding to groove 31 capable of receiving a bent front end 29*b* of the biased element 29, and a recessed area 20 generally conforming to the stop bar 23, and a hole for receiving a pivot bar 22.

In operation, the knife in a closed position is grasped with the rear end 15 of the handle oriented towards the holder's wrist and the bottom 38 of the handle resting in the palm resulting in placement of the thumb bob 37 in close proximity to the holder's thumb. Pressure is applied to the thumb bob 37 upwards in the direction away from the palm, causing the blade to rotate clockwise about the pivot bar 22 and exit the central cavity 19. As the blade is lifted out of the central cavity 19, the bias element 29 is moved past an equilibrium point after which the bias element 29 exerts an opening force on the blade 13. When the end 29*b* reaches a certain critical angle in the arcuate groove 31, the tension of the bias element 29 causes the end 29*b* to quickly slide towards the end 32 of the arcuate slot 31, thereby causing the blade to extend to the full open position. Stop bar 23 communicates with the rear end 43 of the tang 28 to prevent overextension of the blade. When the blade is in the fully extended position, the front end 29*a* of the bias element rests at the far end 32 of the arcuate slot 31 and the rear end 29*a* of the bias element is positioned at the front end 40 of the rear groove 30. When the blade clears the moveable lining free end 27, the free end 27 of the lining extends into the central cavity and becomes lodged against the rear end 43 of the tang 28, thereby preventing the blade 13 from closing.

To close the knife, pressure is applied to the moveable free end 27, of interior lining 17, dislodging the end of the lining from the tang 28, placing the moveable lining in linear arrangement with the lining 17. The blade is then rotated counter-clockwise about the pivot bar 22 towards the central cavity 19, causing the front bias element end 29*b* to slide towards the rear 33 of the arcuate groove 31. When the front bias element end 29*b* reaches a certain critical angle in the arcuate groove 31, the rear 29*a* of the bias element 29 travels to the rear end 42 of the groove 30, thereby permitting the front end 29*b* of the bias element 29 to travel to the rear bottom portion 33, causing the blade 13 to fold into the central cavity 19. In the closed position, the bottom edge of the blade 13 rests against the central casing 18 and the stop bar 23 is received within the recess 20 of the tang 28, preventing further movement of the blade 13 in the closing direction.

It will be appreciated that the mechanism provides positive pressure that facilitates movement of the blade, requiring only limited outside assistance by the user. The amount of outside assistance required to open and close the blade depends upon the angle of the arcuate groove, the length of end positioning of the first groove and the resilience of the bias element.

Figure 3:
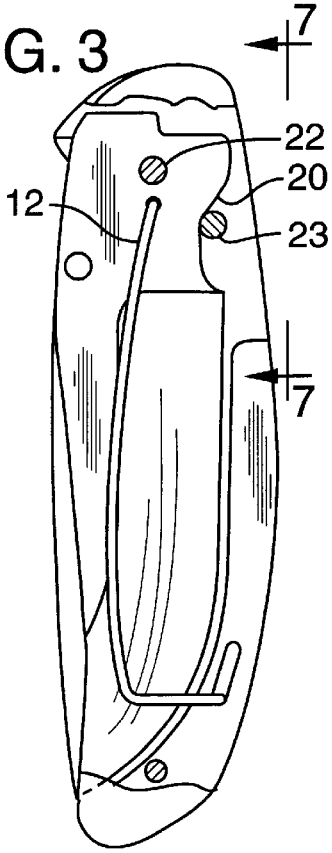
FIG. 3 is a side view of the knife in the closed position displaying the preferred assisting mechanism within the handle with portions broken away to better illustrate the contruction of the knife.

The bias element can be a material such as a spring, wire or equivalent thereof. As seen in the various depicted embodiments, the spring or bias element may be bent in a variety of ways. For example, as seen in FIGS. 3 and 4, the spring or bias element may include a simple bend formed between the opposited ends of the spring or bias element. The simple bend may be at least 90 degrees and, more particularly, may be approximately 120 degrees, as seen in FIG. 4. FIGS. 9 and 10 show that the spring or bias element may have a coiled bend instead of a simple bend. The coiled bend may be 360 degrees or greater, as revealed by FIGS. 9 and 10. For example, the coiled bend shown in FIG. 10 is approximately 480 degrees. The preferred element for the spring or bias element is 0.062 music wire.

In alternate embodiments, the bias element can be a combination of a spring and a push rod, a coiled wire, or similar means. Referring to FIG. 8, the bias element consists of push rod 47 and spring 46 which is housed within longitudinal slot 45 defined between interior lining 17*a* and a recess in side part 14*a,* similar to the way in which bias element 29 is housed in the embodiments shown in FIG. 1–6. Referring to FIGS. 9 and 10, bias element 29 consists of a wire wrapped or coiled about a circular member 47. Other embodiments may be possible based upon the principles disclosed herein. Moreover, the shape of the tang may be modified according to known designs.

In all embodiments, the liner log may be changed to be a lockback or other known locking mechanism. Moreover, the blade may have a thumb bob on both sides of the blade, and the dual thumb bobs may serve as a stop for the blade when in the closed position.

From the foregoing, it will be seen that this invention is one well adapted to attain all the ends and objects hereinabove set forth together with other advantages which are obvious and which are inherent to this structure.

It will be understood that certain features and some combinations are of utility and may be employed without reference to other features and subcombinations. This is contemplated by and is within the scope of the Claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A folding knife, comprising:

a blade having a tang extending outwardly from said blade;

a handle having at least one recessed portion;

a bar pivotally connecting said tang and said handle; and a bias element engaging said blade wherein said bias element is housed within said recessed portion of said handle such that said bias element is substantially to one side of a plane defined by said blade and assists movement of said blade to an open position.

2. A knife according to claim 1, wherein said handle has an arcuate opening rough which said bias element engages said blade.

3. A knife according to claim 2, wherein said opening is concentrically positioned about said bar.

4. A knife according to claim 2, wherein said bias element includes a rod.

5. A knife according to claim 4, wherein said rod is flexible.

6. A knife according to claim 4, wherein said rod includes an angled portion.

7. A knife according to claim 6, wherein said angled portion is received within said arcuate opening.

8. A knife according to claim 1, wherein said bias element includes a spring.

9. A knife according to claim 1, wherein said bias element includes both a rod and a spring.

10. A knife according to claim 1, wherein said bias element is in movable communication within said tang.

11. A knife according to claim 1, wherein said bias element assists movement of said blade to a closed position.

12. A knife according to claim 1 wherein said bias element consists of a wire coiled about a circular member.

13. A pocket knife comprising:

a handle defining a blade-receiving channel;

a blade pivotally mounted to the handle about a tang end of the blade so that the blade may be at least partially stored in the channel in a closed position and pivoted out of the channel to an open position; and a spring formed from a wire having three primary bends, one bend forming a tang end of the spring, and another bend forming a handle end of the spring;

wherein the spring is operatively connected between the handle and the blade such that the spring exerts a pivoting force on the blade.

14. The knife according to claim 13, wherein:

a hole is formed in the tang end of the blade; and the tang end of the spring is placed in the hole in the tang end of the blade.

15. The knife according to claim 13, wherein:

a hole is formed within the handle, adjacent the channel; and the handle end of the spring is placed within the hole in the handle.

16. The knife according to claim 13, wherein the spring exerts an opening force when the blade is moved from the closed position to beyond an equilibrium position.

17. The knife according to claim 13, wherein the spring exerts a closing force when the blade is moved toward the closed position from an equilibrium position.

18. The knife according to claim 13, wherein a third primary bend of the spring is a simple bend of approximately 120-degrees.

19. The knife according to claim 13, wherein a third primary bend of the spring is a simple bend of at least 90-degrees.

20. The knife according to claim 13, wherein a third primary bend of the spring is a coiled bend of approximately 480-degrees.

21. The knife according to claim 13, wherein a third primary bend of the spring is a coiled bend of at least 360-degrees.

22. A pocket knife comprising:

a handle defining a blade-receiving channel;

a blade pivotally mounted to the handle about a tang end of the blade so that the blade may be stored in a closed position at least partially in the channel and pivoted out of the channel to an open position, defining a plane of the blade within which the blade pivots; and a substantially planar spring held within the handle at a location substantially to one side of the plane within which the blade pivots, the spring being operatively connected between the handle and the blade such that the spring exerts a pivoting force on the blade.

23. The knife according to claim 22, wherein the spring defines a plane that is approximately parallel to the plane of the blade.

24. The knife according to claim 22, wherein the spring defines a plane that is approximately parallel to and offset from the plane of the blade.

25. A pocket knife comprising:

a blade having a tang about which the blade may pivot, where the blade is configured so that it defines a plane when pivoted about the tang;

a handle to which the tang of the blade is pivotally mounted, including a spring-receiving cavity within the handle and offset to one side of the plane defined by the blade; and a spring disposed within the spring-receiving cavity and operatively connected between the handle and the blade such that the spring exerts a pivoting force on the blade as the blade is moved from a closed position to an open position, or from the open position to the closed position.

26. The knife according to claim 25, wherein the spring-receiving cavity is defined between a liner and a side of the handle.

27. The knife according to claim 25, wherein the spring is formed from a wire having three primary bends, one bend forming a tang end of the spring, another bend forming a handle end of the spring.

28. The knife according to claim 25, wherein:

a tang end of the spring is placed in a hole in a tang end of the blade; and a handle end of the spring is placed within a hole in the handle.

29. The knife according to claim 25, wherein the spring exerts an opening force when the blade is moved from the closed position to beyond an equilibrium position.

30. The knife according to claim 25, wherein the spring exerts a closing force when the blade is moved toward the closed position from an equilibrium position.

31. A pocket knife having a blade mounted in a channel of a handle, pivoting about a tang of the blade, relative to the handle, and a mechanism for assisting the opening of the blade, said knife comprising:

a hole formed in the tang of the blade;

a hole formed in the handle; and a wire bent and held within the hole in the handle and the hole in the blade to be under compression between the hole in the blade and the hole in the handle for at least a portion of travel of the blade between an open position and a closed position of the blade relative to the handle.

32. The pocket knife according to claim 31, wherein the wire exerts an opening force when the blade is moved from a closed position to beyond an equilibrium position, and the wire exerts a closing force when the blade is moved toward the closed position from the equilibrium position.

33. The pocket-knife according to claim 31, wherein the hole in the handle is elongated so that a portion of the wire may slide along a length of the hole.

34. The pocket knife according to claim 31, wherein the wire is sized and shaped relative to the holes in the blade and the handle so that no opening force is exerted by the wire on the blade for at least a portion of travel of the blade near a fully open position of the blade.

* * * * *

UNITED STATES PATENT AND TRADEMARK OFFICE

CERTIFICATE OF CORRECTION

PATENT NO : 6,145,202

DATED : November 14, 2000

INVENTOR(S) : Kenneth J. Onion

It is certified that error appears in the above-identified patent and that said Letters Patent is hereby corrected as shown below:

[54] OPENING AND CLOSING ASSISTING MECHANISM FOR FOLDING KNIFE

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*